US010115342B2

(12) United States Patent
Li

(10) Patent No.: US 10,115,342 B2
(45) Date of Patent: Oct. 30, 2018

(54) OLED DRIVING CIRCUIT AND OLED DISPLAY APPARATUS

(71) Applicant: Wuhan China Star Optoelectronics Technology Co., Ltd., Wuhan, Hubei (CN)

(72) Inventor: Jun Li, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 115 days.

(21) Appl. No.: 15/328,157

(22) PCT Filed: Dec. 27, 2016

(86) PCT No.: PCT/CN2016/112303

§ 371 (c)(1),
(2) Date: Jan. 23, 2017

(87) PCT Pub. No.: WO2018/098877

PCT Pub. Date: Jun. 7, 2018

(65) Prior Publication Data

US 2018/0211592 A1 Jul. 26, 2018

(30) Foreign Application Priority Data

Dec. 2, 2016 (CN) ..... 2016 1 10972719

(51) Int. Cl.
*G09G 3/3233* (2016.01)

(52) U.S. Cl.
CPC ..... *G09G 3/3233* (2013.01); *G09G 2300/043* (2013.01); *G09G 2300/0871* (2013.01); *G09G 2320/0233* (2013.01)

(58) Field of Classification Search
CPC ..... G09G 3/3233; G09G 2300/0871; G09G 2320/0233; G09G 2300/043
See application file for complete search history.

(56) References Cited

U.S. PATENT DOCUMENTS

2012/0038683 A1 2/2012 Park

FOREIGN PATENT DOCUMENTS

| | | | |
|---|---|---|---|
| CN | 1728219 | A | 2/2006 |
| CN | 104282268 | A | 1/2015 |
| CN | 104575367 | A | 4/2015 |
| CN | 104575377 | A | 4/2015 |
| CN | 105513540 | A | 4/2016 |
| CN | 105609052 | A | 5/2016 |

*Primary Examiner* — Abhishek Sarma
(74) *Attorney, Agent, or Firm* — Andrew C. Cheng

(57) ABSTRACT

The present application discloses an OLED driving circuit and an OLED display panel. The OLED driving circuit including a switch thin film transistor, a driver thin film transistor, a storage capacitor, and a compensation circuit, a first terminal of the switch thin film transistor receives data signal, a gate of the switch thin film transistor receives the nth level scanning signal, a the second terminal of the switch thin film transistor is electrically connected to a first terminal of the driver thin film transistor, a gate of the driver thin film transistor is electrically connected to a voltage source through the storage capacitor, and a second terminal of the driver thin film transistor is electrically connected to the positive electrode of the OLED through partial of the elements in the compensation circuit, the negative electrode of the OLED is loaded low electrical level.

8 Claims, 9 Drawing Sheets

OLED DRIVING CIRCUIT AND OLED DISPLAY APPARATUS

CROSS REFERENCE

This application claims priority to Chinese Patent Application No. 201611097271.9, entitled "OLED DRIVING CIRCUIT AND OLED DISPLAY APPARATUS", filed on Dec. 2, 2016, which is incorporated by reference in its entirety.

FIELD OF THE INVENTION

The present application relates to a display technology field, and more particularly to an OLED driving circuit and an OLED display apparatus.

BACKGROUND OF THE INVENTION

Organic light-emitting diodes, OLED display panels have been favored because of their characteristic such as thinness, energy saving, wide viewing angle, wide color gamut, and high contrast. The basic driving circuit of the OLED is shown in FIG. 1. FIG. 1 is a schematic diagram of the OLED driving circuit in the conventional technology. The driving circuit is for driving the OLED, the driving circuit includes a switch thin-film transistor, TFT T1, a driver thin-film transistor, TFT T2 and a storage capacitor Cst, this structure is also called a 2T1C structure. The gate of the switch thin-film transistor T1 receives scanning signal SCAN, the drain of the switch thin-film transistor T1 receives data signal Data, the source of the switch thin-film transistor T1 is electrically connected to the gate of the driving thin-film transistor T2. The source of the switch thin-film transistor T1 and the drain of the switch thin-film transistor T1 are turned on or turn off under the control of the scanning signal SCAN. When the source of the switch thin-film transistor T1 and the drain of the switch thin-film transistor T1 are turned on under the control of the scanning signal SCAN, the data signal Data is transferred to the gate of the driving thin-film transistor T2. The source of the driver thin film transistor T2 is electrically connected to a high electric potential VDD, and the drain of the driver thin film transistor T2 is electrically connected to the positive electrode of the OLED. The positive electrode of the OLED is electrically connected to a low electric potential VSS. The two terminals of the storage capacitor Cst are electrically connected to the gate of the driver thin film transistor T2 and the drain of the driver thin film transistor T2, respectively. The current flowing through the OLED is: $I_{OLED}=k(V_{gs}-V_{th})^2$. Wherein, $I_{OLED}$ is a current flowing through the OLED, also referred to as a driving current of the OLED; k is a current amplification factor of the driver thin film transistor T2 and it is determined by the characteristics of the driver thin film transistor T2 itself; $V_{gs}$ is a voltage between the gate and the source of the driver thin film transistor T2; and $V_{th}$ is a threshold voltage of the driver thin film transistor T2. As it can be seen, the current flowing through the OLED is related to the threshold voltage $V_{th}$ of the driver thin film transistor T2. Since the threshold voltage $V_{th}$ of the driver thin film transistor T2 is easy to drift, resulting in a change of the current $I_{OLED}$ flowing through the OLED, a change in the current $I_{OLED}$ flowing through the OLED will causes a change in the light emission luminance of the OLED, and influence the image quality of the OLED display panel.

SUMMARY OF THE INVENTION

The present application provides an OLED driving circuit for generating a driving current to drive an Organic Light-Emitting Diode (OLED), wherein the OLED driving circuit including a switch thin film transistor, a driver thin film transistor, a storage capacitor, and a compensation circuit, each of the switch thin film transistor and the driver thin film transistor including a gate, a first terminal and a second terminal, a first terminal of the switch thin film transistor receives data signal, a gate of the switch thin film transistor receives the nth level scanning signal, a the second terminal of the switch thin film transistor is electrically connected to a first terminal of the driver thin film transistor, a gate of the driver thin film transistor is electrically connected to a voltage source through the storage capacitor, and a second terminal of the driver thin film transistor is electrically connected to the positive electrode of the OLED through partial of the elements in the compensation circuit, the negative electrode of the OLED is loaded low electrical level, the compensation circuit is configured to compensate for a change of the driving current flowing through the OLED caused by the drift of the threshold voltage of the driver thin film transistor; wherein the first terminal is a source and the second terminal is a drain or the first terminal is a drain and the second terminal is a source.

Wherein the driver thin film transistor is referred to as a first thin film transistor, the switch thin film transistor is referred to as a third thin film transistor, the compensation circuit including a second thin film transistor, a fourth thin film transistor, a fifth thin film transistor, and a sixth thin film transistor, the second thin film transistor, the fourth thin film transistor, the fifth thin film transistor, and the sixth thin film transistor all including a gate, a first terminal, and a second terminal, respectively, a gate of the sixth thin film transistor receives the enable signal, a first terminal of the sixth thin film transistor is loaded with the second electrical level, a second terminal of the sixth thin film transistor is electrically connected to the a terminal of the third thin film transistor, a second terminal of the third thin film transistor receives the data signal, and a gate of the third thin film transistor receives the nth level scanning signal, a first terminal of the first thin film transistor is electrically connected to the second terminal of the sixth thin film transistor, a second terminal of the first thin film transistor is electrically connected to a first terminal of the second thin film transistor, a gate of the first thin film transistor is connected to the first terminal of the sixth thin film transistor through the storage capacitor, a second terminal of the second thin film transistor is electrically connected to the gate of the first thin film transistor, and a gate of the second thin film transistor receives the nth level scanning signal, a gate of the fourth thin film transistor receives the n−1th level scanning signal, a first terminal of the fourth thin film transistor is electrically connected to the gate of the first thin film transistor, a second terminal of the fourth thin film transistor is loaded with a first electric level, a first terminal of the fifth thin film transistor is electrically connected to the second terminal of the first thin film transistor, a second terminal of the fifth thin film transistor is electrically connected to the positive electrode of the OLED, a gate of the thin film transistor receives the enable signal, and the negative electrode of the OLED is loaded with a low electric level, wherein, the first terminal is a source and the second terminal is a drain, or the first terminal is a drain and the second terminal is a source;

during the first period of time: the (n−1)th level scanning signal is at the first electric level, the fourth thin film transistor turned on, the gate of the first thin film transistor is reset to the first electric level through the fourth thin film transistor; the nth level scanning signal is at the second electric level, the second thin film transistor and the third thin film transistor are turned off; the enable signal is at the second electric level, the fifth thin film transistor and the sixth thin film transistor are turned off;

during the second period of time: the (n−1)th level scanning signal is at the second electric level, the fourth thin film transistor turned off; the nth level scanning signal is at the first electric level, the second thin film transistor and the third thin film transistor are turned on, the data signal is written by the first terminal of the first thin-film transistor through the third thin film transistor; the enable signal is at the second electric level, the fifth thin-film transistor and the sixth thin-film transistor are turned off;

during the third period of time: the (n−1)th level scanning signal is at the second electric level, the fourth thin film transistor turned off; the nth level scanning signal is at the second electric level, the second thin film transistor and the third thin film transistor are turned off, the enable signal is at a first electric level, the fifth thin film transistor and the sixth thin film transistor are turned on to drive the OLED to emit light, wherein the nth level scanning signal is delayed by T/M relative to the n−1th level scanning signal, wherein M is a positive integer and T is a period of the scanning signal.

Wherein the gate of the first thin film transistor is loaded with a compensating leakage current, the compensating leakage current is configured to compensate for an existence of leakage current due to the second thin film transistor and the fourth thin film transistor during the third period of time and leading to the decreasing of the electric potential of the gate of the first thin film transistor.

Wherein the compensation circuit further including a seventh thin film transistor, the seventh thin film transistor including a gate, a first terminal, and a second terminal, a second terminal of the seventh thin film transistor is electrically connected to the gate of the first thin film transistor, a gate of the seventh thin film transistor and a first terminal of the seventh thin film transistor are all loaded with the second electric level so that the seventh thin film transistor maintains a normally-off state.

Wherein the first terminal of the sixth thin film transistor is electrically connected to a first port, the first terminal is loaded with a second electric level, the first terminal of the seventh thin film transistor is electrically connected to the first port, the gate of the seventh thin film transistor is electrically connected to a second port, the second port is loaded with the second electric level.

Wherein the first terminal of the seventh thin film transistor and the gate of the seventh thin film transistor are electrically connected to a second port, wherein the second port is loaded with the second electric level.

Wherein the first terminal of the seventh thin film transistor and the gate of the seventh thin film transistor are electrically connected to a second port, wherein the second port is loaded the (n−2)th level scanning signal, wherein the (n−1)th level scanning signal is delayed by T/M relative to the (n−2)th level scanning signal, during the third period of time, the (n−2)th level scanning signal is the second electric level.

Wherein all of the first thin film transistor, the second thin film transistor, the third thin film transistor, the fourth thin film transistor, the fifth thin film transistor, and the sixth The thin film transistor are PTFT, the first electric level is a low electric level, and the second electric level is a high electric level.

Wherein all of the first thin film transistor, the second thin film transistor, the third thin film transistor, the fourth thin film transistor, the fifth thin film transistor, and the sixth The thin film transistor are NTFT, the first electric level is a high electric level, and the second electric level is a low electric level.

The driving current of the OLED of the present application can compensate for a change of the driving current of the OLED caused by the drift of the threshold voltage of the driver thin film transistor, thereby stabilizing the driving current of the OLED, improve the image quality of the OLED display panel with the application of the OLED driving circuit.

The present application further provides a OLED display panel, the OLED display panel includes the OLED driving circuit in any one of the embodiments described above.

BRIEF DESCRIPTION OF THE DRAWINGS

In order to more clearly illustrate the embodiments of the present application or prior art, the following figures will be described in the embodiments are briefly introduced. It is obvious that the drawings are merely some embodiments of the present application, those of ordinary skill in this field can obtain other figures according to these figures without paying the premise.

DETAILED DESCRIPTION OF PREFERRED EMBODIMENTS

Embodiments of the present application are described in detail with the technical matters, structural features, achieved objects, and effects with reference to the accompanying drawings as follows. It is clear that the described embodiments are part of embodiments of the present application, but not all embodiments. Based on the embodiments of the present application, all other embodiments to those of ordinary skill in the premise of no creative efforts acquired should be considered within the scope of protection of the present application.

Specifically, the terminologies in the embodiments of the present application are merely for describing the purpose of the certain embodiment, but not to limit the invention.

It is to be noted here that in order to avoid obscuring the present invention with unnecessary detail, only the structure and/or processing steps closely related to the approach according to the invention are illustrated in the accompanying drawings, other details of the present invention not closed to the present application is omitted.

Figure 1:
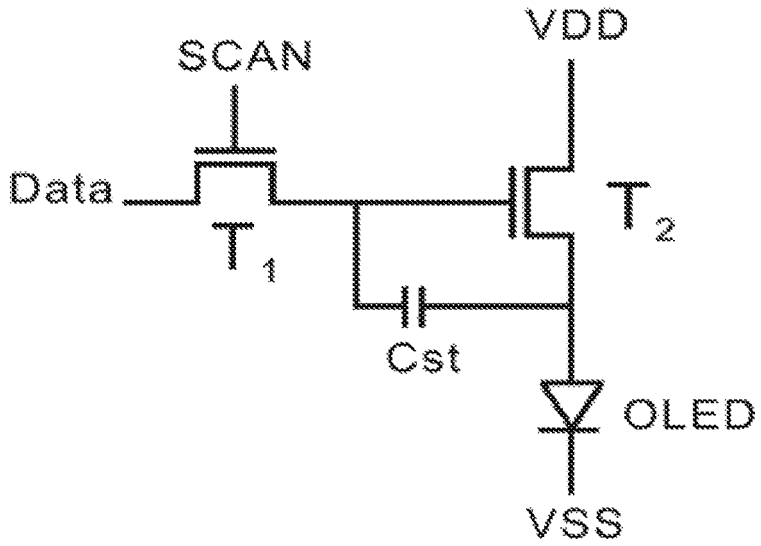
FIG. 1 is a schematic diagram of the OLED driving circuit in the conventional technology.
Figure 2:
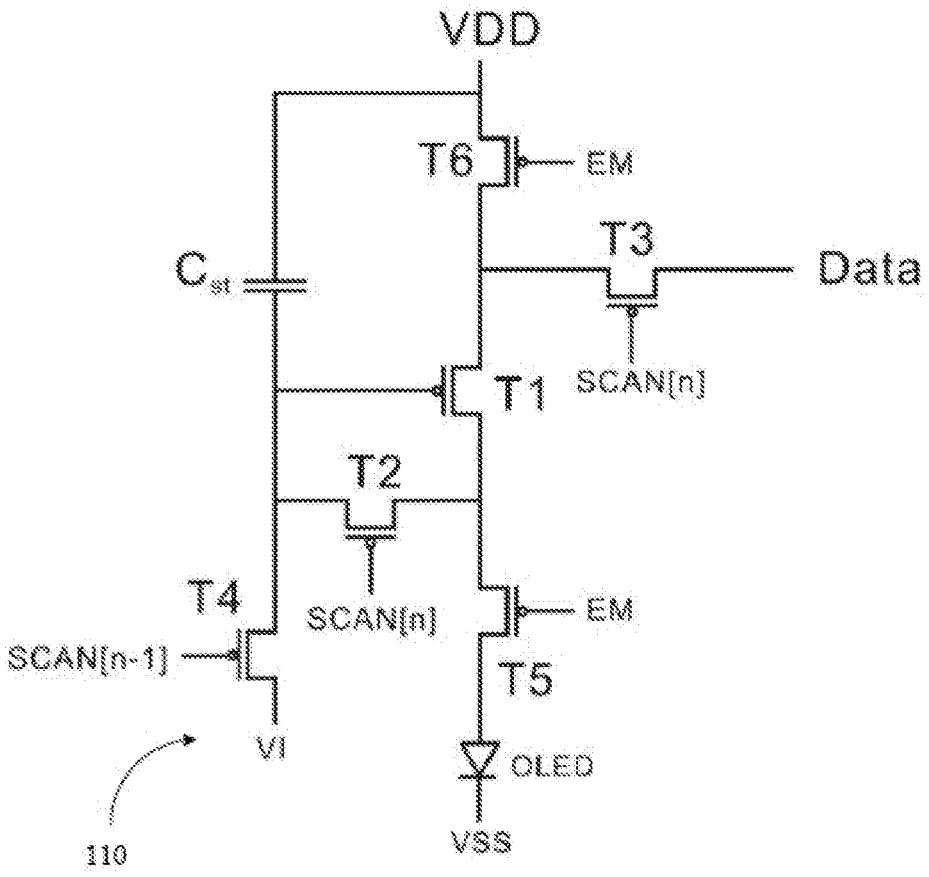
FIG. 2 is a schematic diagram of the OLED driving circuit according to a first preferred embodiment of the present application.
Figure 3:
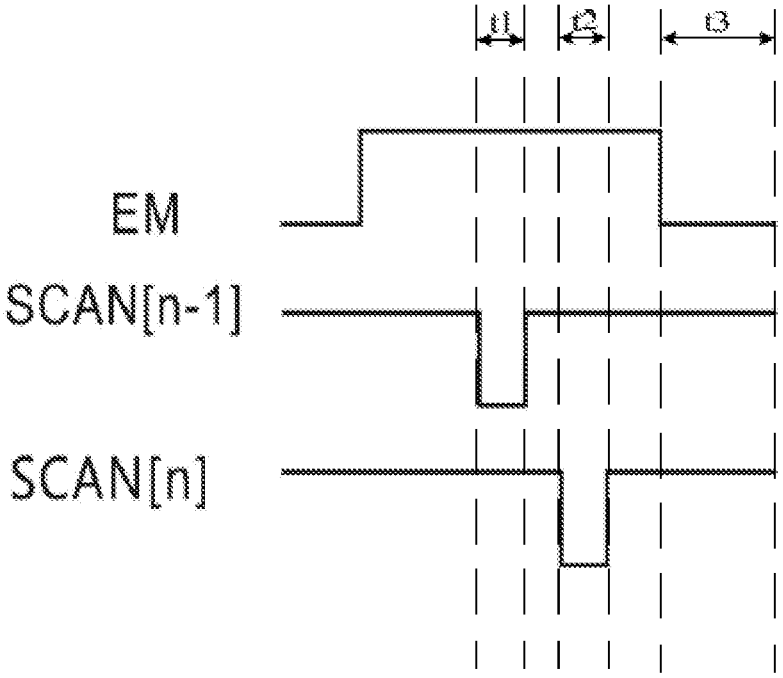
FIG. 3 is a timing diagram of the respective signals of the OLED driving circuit illustrated in FIG. 2.

Combined referring to FIGS. 2-3, FIG. 2 is a schematic diagram of the OLED driving circuit according to a first preferred embodiment of the present application; FIG. 3 is a timing diagram of the respective signals of the OLED driving circuit illustrated in FIG. 2. The OLED driving circuit 100 is for generating a driving current to drive an Organic Light-Emitting Diode, OLED. The OLED driving circuit includes a switch thin film transistor, TFT T3, a driver thin film transistor, TFT T1, a storage capacitor Cst, and a compensation circuit 110. Each of the switch thin film transistor T3 and the driver thin film transistor T1 includes a gate, a first terminal and a second terminal. The first terminal of the switch thin film transistor T3 receives data signal (illustrated as Data in the FIGS.), the gate of the switch thin film transistor T3 receives the nth level scanning signal (SCAN[n]), and the second terminal of the switch thin film transistor T3 is electrically connected to a first terminal of the driver thin film transistor T1. The gate of the driver thin film transistor T3 is electrically connected to a voltage source VDD through the storage capacitor Cst, and the second terminal of the driver thin film transistor T3 is electrically connected to the positive electrode of the OLED through partial of the elements in the compensation circuit. The negative electrode of the OLED is loaded low electrical level. The compensation circuit 110 is configured to compensate for a change of the driving current flowing through the OLED caused by the drift of the threshold voltage of the driver thin film transistor T1. In other words, if the compensation circuit 110 is not provided in the OLED driving circuit 100, the drift of the threshold voltage of the driver thin film transistor T1 will brings the change of the driving current of the OLED (also called the current flowing through the OLED), thereby affecting the light emission luminance of the OLED and influence the image quality of the OLED display panel. The compensation circuit 110 is configured to compensate for such a change of the driving current of the OLED caused by the drift of the threshold voltage of the driver thin film transistor T1, thereby stabilizing the driving current of the OLED, improve the image quality of the OLED display panel with the application of the OLED driving circuit. Wherein the first terminal is a source and the second terminal is a drain; or the first terminal is a drain and the second terminal is a source.

For convenience of description, the driver thin film transistor is referred to as a first thin film transistor T1, and the switch thin film transistor is referred to as a third thin film transistor T3. The compensation circuit 110 includes a second thin film transistor T2, a fourth thin film transistor T4, a fifth thin film transistor T5, and a sixth thin film transistor T6. Wherein the second thin film transistor T2, the fourth thin film transistor T4, the fifth thin film transistor T5, and the sixth thin film transistor T6 include a gate, a first terminal, and a second terminal, respectively. Wherein the first terminal is a source and the second terminal is a drain; or the first terminal is a drain and the second terminal is a source. A gate of the sixth thin film transistor T6 receives the enable signal EM, a first terminal of the sixth thin film transistor T6 is loaded with the second electrical level, a second terminal of the sixth thin film transistor T6 is electrically connected to the a terminal of the third thin film transistor T3. A second terminal of the third thin film transistor T3 receives the data signal Data, and a gate of the third thin film transistor T3 receives the nth level scanning signal SCAN[n]. A first terminal of the first thin film transistor T1 is electrically connected to a second terminal of the sixth thin film transistor T6, a second terminal of the first thin film transistor T1 is electrically connected to a first terminal of the second thin film transistor T2, a gate of the first thin film transistor T1 is connected to a first terminal of the sixth thin film transistor T6 through the storage capacitor Cst. A second terminal of the second thin film transistor T2 is electrically connected to the gate of the first thin film transistor T1, and a gate of the second thin film transistor T2 receives the nth level scanning signal SCAN[n]. The gate of the fourth thin film transistor T4 receives the n−1th level scanning signal SCAN[n−1], the first terminal of the fourth thin film transistor T4 is electrically connected to the gate of the first thin film transistor T1, the second terminal of the fourth thin film transistor T4 is loaded with a first electric level. A first terminal of the fifth thin film transistor T5 is electrically connected to the second terminal of the first thin film transistor T1, a second terminal of the fifth thin film transistor T5 is electrically connected to a positive electrode of the OLED, a gate of the thin film transistor T5 receives the enable signal EM, and the negative electrode of the OLED is loaded with a low electric level. Wherein, in one embodiment, the first terminal is a source and the second terminal is a drain; or in another embodiment, the first terminal is a drain and the second terminal is a source.

The operation principle of the OLED driving circuit according to the first preferred embodiment of the present application is described with reference to FIGS. 2-3.

During the first period of time t1 (also referred to as a reset stage of the gate of the driver thin film transistor): the (n−1)th level scanning signal SCAN[n−1] is at the first electric level, the fourth thin film transistor T4 are turned on, the gate of the first thin film transistor T1 is reset to the first electric level through the fourth thin film transistor T4; the nth level scanning signal SCAN[n] is at the second electric level, the second thin film transistor T2 and the third thin film transistor T3 are turned off; the enable signal EM is at the second electric level, the fifth thin film transistor T5 and the sixth thin film transistor T6 are turned off.

During the second period of time t2 (also referred to as a data signal writing and threshold voltage compensating stage): the (n−1)th level scanning signal SCAN[n−1] is at the second electric level, the fourth thin film transistor T4 are turned off; the nth level scanning signal SCAN[n] is at the first electric level, the second thin film transistor T2 and the third thin film transistor T3 are turned on, the data signal Data is written by the first terminal of the first thin-film transistor T1 through the third thin film transistor T3; the enable signal EM is at the second electric level, the fifth thin-film transistor T5 and the sixth thin-film transistor T6 are turned off. In this stage, the gate and the second terminal of the first thin film transistor T1 are short-circuited to form a diode connect structure, the data signal Data is written by the first terminal of the first thin-film transistor T1 through the third thin film transistor T3 to charge the electric potential of the gate of the first thin film transistor T1 to Vdata-|Vth|. Vdata is the voltage of the data signal Data, Vth is the threshold voltage of the first thin film transistor T1.

During the third period of time t3: the (n−1)th level scanning signal SCAN[n−1] is at the second electric level, the fourth thin film transistor T4 is turned off; the nth level scanning signal SCAN[n] is at the second electric level, the second thin film transistor T2 and the third thin film transistor T3 are turned off, the enable signal EM is at a first electric level, the fifth thin film transistor T5 and the sixth thin film transistor T6 are turned on to drive the OLED to emit light. Wherein the nth level scanning signal SCAN[n]

is delayed by T/M relative to the n−1th level scanning signal SCAN[n−1], wherein M is a positive integer and T is a period of the scanning signal SCAN[n] and SCAN[n−1].

The driving current of the OLED generated by the OLED driving circuit according to the first preferred embodiment of the present application is: $I_{OLED}=k[V_{DD}-(V_{data}-|V_{th}|)-|V_{th}|]^2=k(V_{DD}-V_{data})^2$. Wherein, $I_{OLED}$ refers to a driving current of the OLED; k refers to a current amplification factor of the driver thin film transistor (i.e., the first thin film transistor)T1, which is determined by the characteristics of the driver thin film transistor T1 itself; $V_{DD}$ is a voltage of the voltage source VDD; $V_{data}$ is the voltage of the data signal Data. It can be seen that the driving current $I_{OLED}$ of the OLED is not related to the threshold voltage Vth of the driver thin film transistor T1. Therefore, compared to the conventional technology, the driving current of the OLED generated by the OLED driving circuit of the present application does not change by the drift of the threshold voltage Vth of the driver thin film transistor T1, thereby stabilizing the driving current of the OLED, and the stability of the driving current of OLED does not affect the emission luminance of the OLED and improves the image quality of the OLED display panel applied with the OLED driving circuit.

In the present embodiment, all of the first thin film transistor T1, the second thin film transistor T2, the third thin film transistor T3, the fourth thin film transistor T4, the fifth thin film transistor T5, and the sixth The thin film transistor T6 are PTFT (P Thin Film Transistor), the first electric level is a low electric level, and the second electric level is a high electric level. The electric characteristic of the PTFT is when the gate of the PTFT is loaded with a high electric level, the PTFT are turned off; when the gate of the PTFT is loaded with a low electric level, the PTFT are turned on.

It can be understood that, in other embodiments, all of the first thin film transistor T1, the second thin film transistor T2, the third thin film transistor T3, the fourth thin film transistor T4, the fifth thin film transistor T5, the sixth thin film transistor T6 are NTFT (N Thin Film Transistor), and the first electric level is a high electric level, and the second electric level is a low electric level. The electric characteristic of the NTFT is when the gate of the NTFT is loaded with a high electric level, the PTFT are turned on; when the gate of the NTFT is loaded with a low electric level, the NTFT are turned off.

Figure 4:
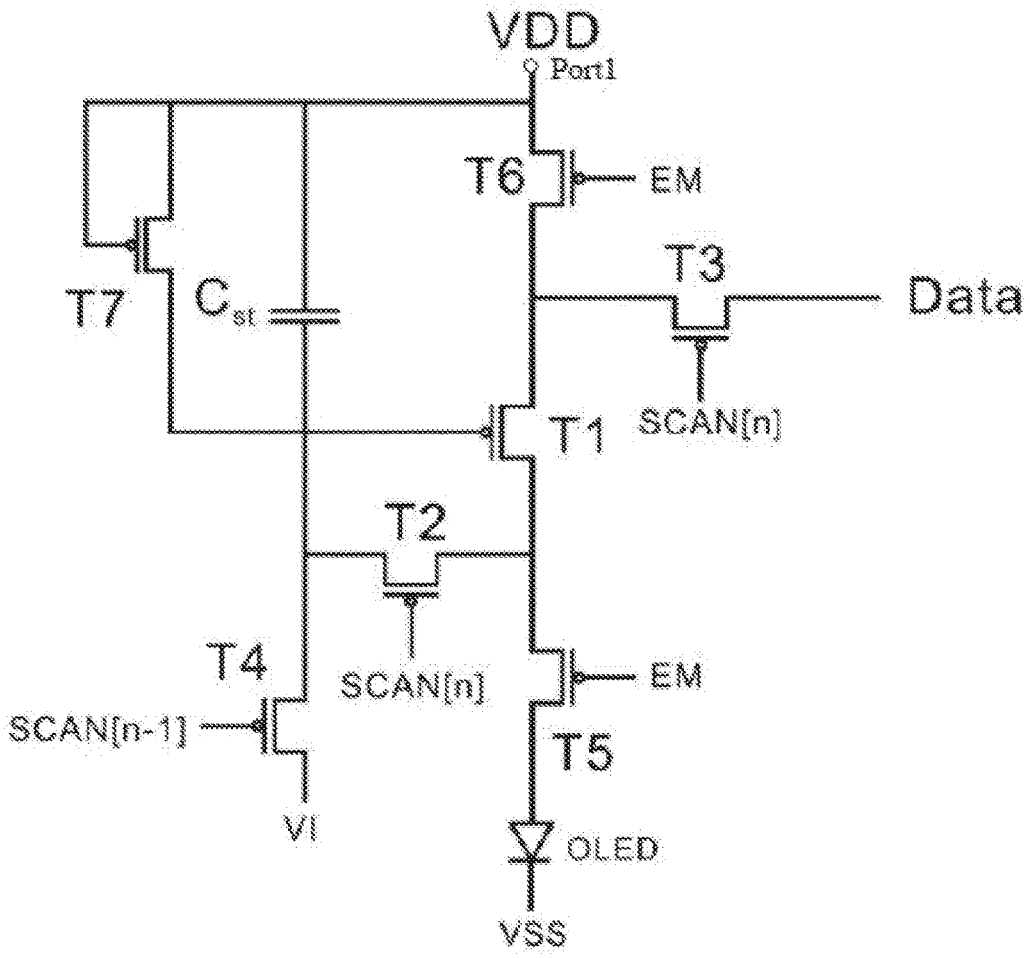
FIG. 4 is a schematic diagram of the OLED driving circuit according to a second preferred embodiment of the present application.
Figure 5:
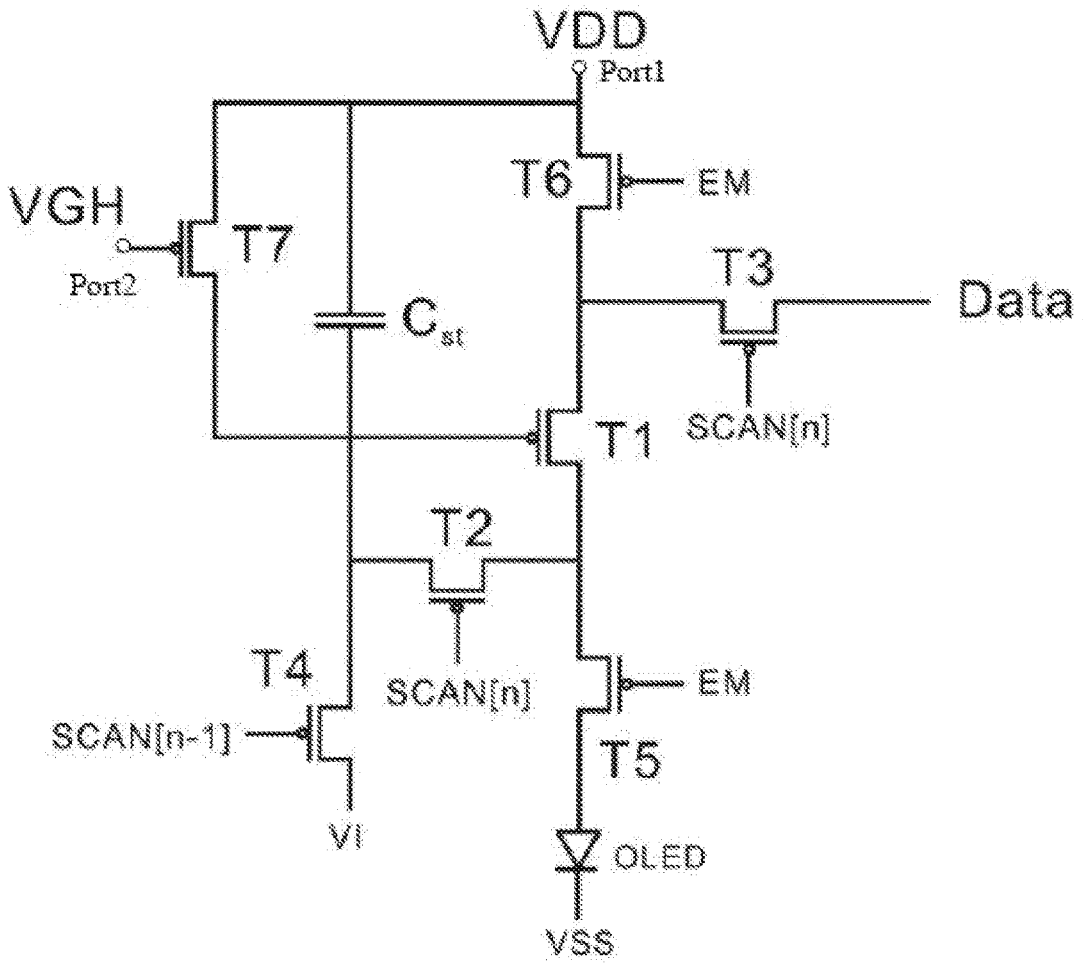
FIG. 5 is a schematic diagram of the OLED driving circuit according to a third preferred embodiment of the present application.
Figure 6:
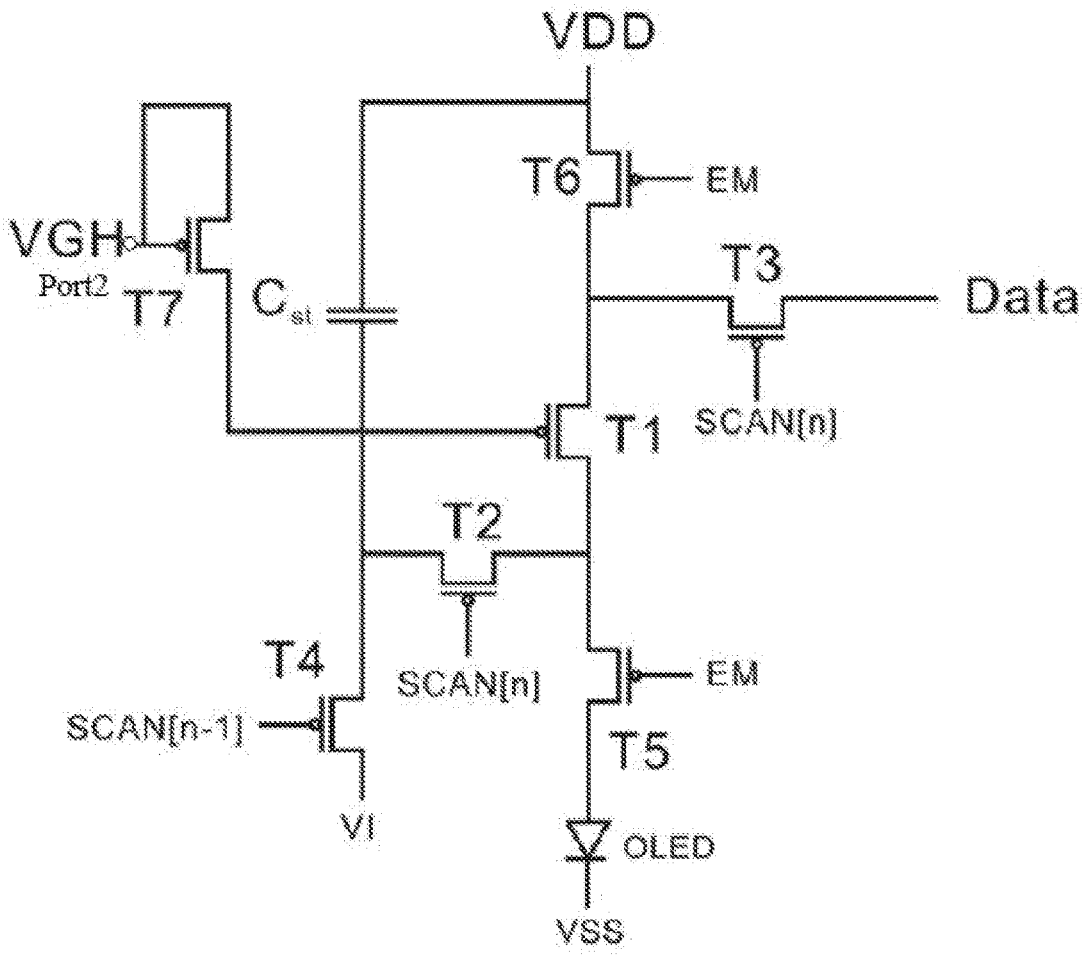
FIG. 6 is a schematic diagram of the OLED driving circuit according to a fourth preferred embodiment of the present application.
Figure 7:
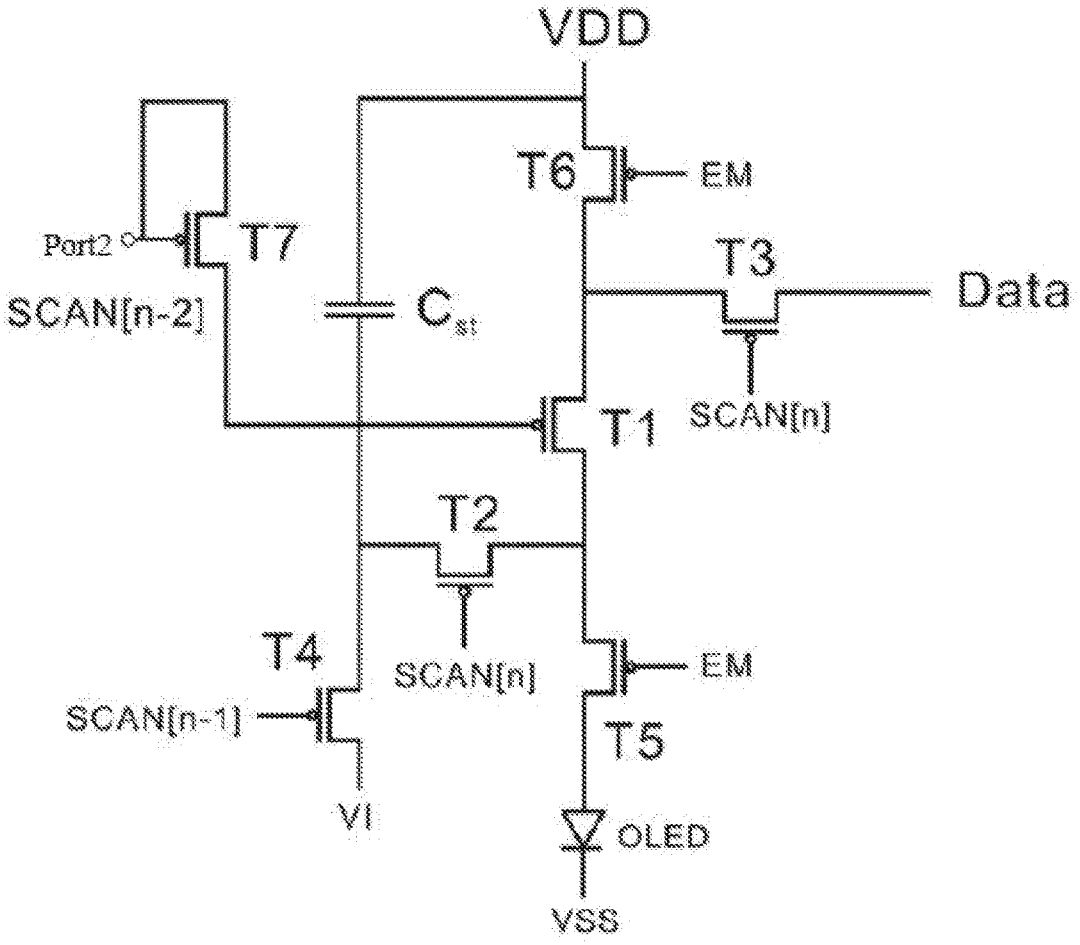
FIG. 7 is a schematic diagram of the OLED driving circuit according to a fifth preferred embodiment of the present application.
Figure 8:
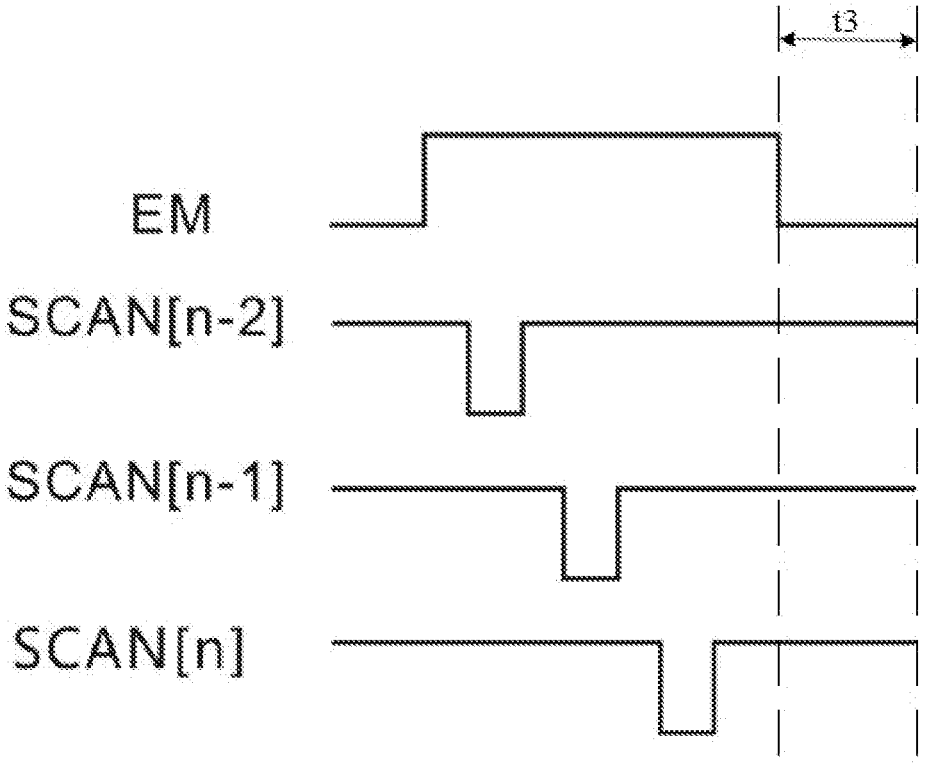
FIG. 8 is a timing diagram of the respective signals of the OLED driving circuit illustrated in FIG. 7.

Referring to FIGS. 4, 5, 6, 7, and 8, FIG. 4 is a schematic diagram of the OLED driving circuit according to a second preferred embodiment of the present application; FIG. 5 is a schematic diagram of the OLED driving circuit according to a third preferred embodiment of the present application; FIG. 6 is a schematic diagram of the OLED driving circuit according to a fourth preferred embodiment of the present application; FIG. 7 is a schematic diagram of the OLED driving circuit according to a fifth preferred embodiment of the present application; FIG. 8 is a timing diagram of the respective signals of the OLED driving circuit illustrated in FIG. 7. The gate of the first thin film transistor T1 is loaded with a compensating leakage current, the compensating leakage current is configured to compensate for an existence of leakage current due to the second thin film transistor T2 and the fourth thin film transistor T4 during the third period of time t3 and leading to the electric potential of the gate of the first thin film transistor T1 is decreased. Specifically, during the third period of time t3, the second thin-film transistor T2 and the fourth thin-film transistor T4 are turned off, and the second thin-film transistor T2 and the fourth thin-film transistor T4 are both leaked current, the leakage currents of the second thin film transistor T2 and the fourth thin film transistor T4 cause the electric potential of the gate of the first thin film transistor T1 to gradually decrease and therefore cause the OLED display panel having the OLED driving circuit has a gray scale shift, and the image quality of the OLED display panel is affected. Therefore, a compensating leakage current is applied to the first thin-film transistor T1, the compensating leakage current is configured to compensate for an existence of leakage current due to the second thin film transistor T2 and the fourth thin film transistor T4 during the third period of time t3 and leading to the decreasing of the electric potential of the gate of the first thin film transistor T1, thereby reducing or preventing the gray-scale shift of the OLED display panel to which the OLED driving circuit is applied, and reducing the affecting of the image quality of the OLED display panel.

In particular, the compensation circuit 110 further includes a seventh thin film transistor T7, the seventh thin film transistor T7 including a gate, a first terminal, and a second terminal. The second terminal of the seventh thin film transistor T7 is electrically connected to the gate of the first thin film transistor T1, the gate of the seventh thin film transistor T7 and the first terminal of the seventh thin film transistor T7 are all loaded with the second electric level so that the seventh thin film transistor T7 maintains a normally-off state. Wherein the first terminal is a source and the second terminal is a drain; or in other embodiments, the first terminal is a drain and the second terminal is a source. In the present embodiment (the embodiment described in FIGS. 4 to 8), the seventh thin film transistor T7 is a PTFT, and the second electric level is a high electric level. It can be understood that, in other embodiments, the seventh thin film transistor T7 is NTFT and the second electric level is a low electric level.

In one embodiment, referring to FIG. 4, a first terminal of the sixth thin film transistor T6 is electrically connected to a first port Port1, the first terminal is loaded with a second electric level, the first terminal of the seventh thin film transistor T7 and the gate of the seventh thin film transistor T7 are electrically connected to the first port, and the second terminal of the seventh thin film transistor T7 is electrically connected to the gate of the first thin film transistor T1.

In one embodiment, referring to FIG. 5, the first terminal of the sixth thin film transistor T6 is electrically connected to a first port Port1, the first port Port1 is loaded with the second electric level, the first terminal of the seventh thin film transistor T7 is electrically connected to the first port Port1, the gate of the seventh thin film transistor T7 is electrically connected to a second port Port2, the second port Port2 is loaded with the second electric level (illustrated as VGH in the figure), and the second terminal of the seventh thin film transistor T7 is electrically connected to the gate of the first thin film transistor T1.

In another embodiment, referring to FIG. 6, the first terminal of the seventh thin film transistor T7 and the gate of the seventh thin film transistor T7 are both electrically connected to a second port Port2, wherein the second port Port2 is loaded with the second electric level (illustrated as VGH in the figure), the second terminal of the seventh thin film transistor T7 is electrically connected to the gate of the first thin film transistor T1. Combining referring to FIGS. 7 and 8, the first terminal of the seventh thin film transistor T7 and the gate electrode of the seventh thin film transistor T7 are both electrically connected to the second port Port2, wherein the second port Port2 is loaded the (n−2)th level scanning signal SCAN[n−2], wherein the (n−1)th level scanning signal SCAN[n−1] is delayed by T/M relative to the (n−2)th level scanning signal SCAN[n−2], during the third period of time t3, the (n−2)th level scanning signal SCAN[n−2] is the second electric level.

The OLED drive circuit of the present application has a leakage current in both the second thin film transistor T2 and the fourth thin film transistor T4, when the leakage current existing in the second thin film transistor T2 and the fourth thin film transistor T4 causes the gate potential of the first thin film transistor T1 is gradually decreased, a technology approach adopted is to load a compensating current to the gate of the first thin-film transistor T1, and adopted a technology approach to provide the seventh thin-film transistor T7, the second terminal of the seventh thin-film transistor T7 is electrically connecting to the gate of the first thin film transistor T1 and maintaining the seventh thin film transistor in a normally-off state to compensate for a decrease in the gate potential of the first thin film transistor T1. In this case, it is not necessary to design the second thin film transistor T2 and the fourth thin film transistor T4 as a dual gate structure respectively, and the number of the thin film transistors to be used can be reduced, so that the OLED driving circuit of the present embodiment becomes compact and saves space.

Figure 9:
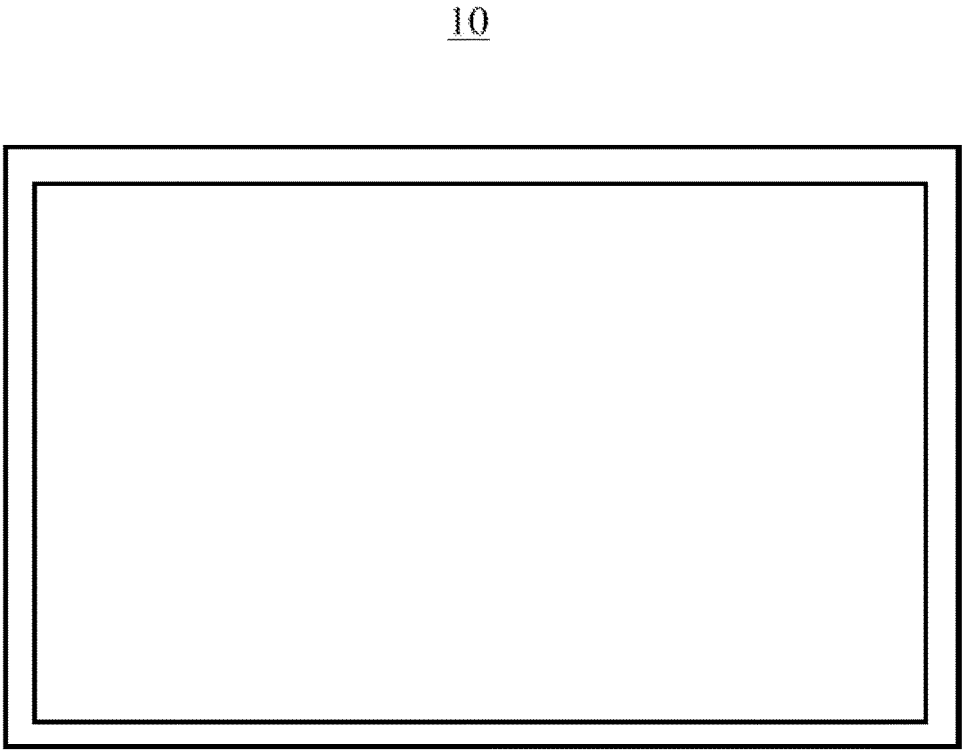
FIG. 9 is a schematic diagram of the OLED display panel according to a preferred embodiment of the present application.

The OLED display panel of the present application will be described below in conjunction with the OLED drive circuit of the present application. Referring FIG. 9, FIG. 9 is a schematic view of an OLED display panel according to a preferred embodiment of the present application. The OLED display panel 10 of the present application includes the OLED driving circuit 100 described in any one of the embodiments described above, and will not be described again.

Above are embodiments of the present application, which does not limit the scope of the present application. Any modifications, equivalent replacements or improvements within the spirit and principles of the embodiment described above should be covered by the protected scope of the invention.

What is claimed is:

1. An OLED driving circuit is for generating a driving current to drive an Organic Light-Emitting Diode (OLED), wherein the OLED driving circuit comprising a switch thin film transistor, a driver thin film transistor, a storage capacitor, and a compensation circuit, each of the switch thin film transistor and the driver thin film transistor comprising a gate, a first terminal and a second terminal, a first terminal of the switch thin film transistor receives data signal, a gate of the switch thin film transistor receives the nth level scanning signal, a the second terminal of the switch thin film transistor is electrically connected to a first terminal of the driver thin film transistor, a gate of the driver thin film transistor is electrically connected to a voltage source through the storage capacitor, and a second terminal of the driver thin film transistor is electrically connected to the positive electrode of the OLED through partial of the elements in the compensation circuit, the negative electrode of the OLED is loaded low electrical level, the compensation circuit is configured to compensate for a change of the driving current flowing through the OLED caused by the drift of the threshold voltage of the driver thin film transistor; wherein the first terminal is a source and the second terminal is a drain or the first terminal is a drain and the second terminal is a source, wherein the driver thin film transistor is referred to as a first thin film transistor, the switch thin film transistor is referred to as a third thin film transistor, the compensation circuit comprising a second thin film transistor, a fourth thin film transistor, a fifth thin film transistor, and a sixth thin film transistor, the second thin film transistor, the fourth thin film transistor, the fifth thin film transistor, and the sixth thin film transistor all comprising a gate, a first terminal, and a second terminal, respectively, a gate of the sixth thin film transistor receives the enable signal, a first terminal of the sixth thin film transistor is loaded with the second electrical level, a second terminal of the sixth thin film transistor is electrically connected to the a terminal of the third thin film transistor, a second terminal of the third thin film transistor receives the data signal, and a gate of the third thin film transistor receives the nth level scanning signal, a first terminal of the first thin film transistor is electrically connected to the second terminal of the sixth thin film transistor, a second terminal of the first thin film transistor is electrically connected to a first terminal of the second thin film transistor, a gate of the first thin film transistor is connected to the first terminal of the sixth thin film transistor through the storage capacitor, a second terminal of the second thin film transistor is electrically connected to the gate of the first thin film transistor, and a gate of the second thin film transistor receives the nth level scanning signal, a gate of the fourth thin film transistor receives the (n−1)th level scanning signal, a first terminal of the fourth thin film transistor is electrically connected to the gate of the first thin film transistor, a second terminal of the fourth thin film transistor is loaded with a first electric level, a first terminal of the fifth thin film transistor is electrically connected to the second terminal of the first thin film transistor, a second terminal of the fifth thin film transistor is electrically connected to the positive electrode of the OLED, a gate of the thin film transistor receives the enable signal, and the negative electrode of the OLED is loaded with a low electric level, wherein, the first terminal is a source and the second terminal is a drain, or the first terminal is a drain and the second terminal is a source; during the first period of time: the (n−1)th level scanning signal is at the first electric level, the fourth thin film transistor turned on, the gate of the first thin film transistor is reset to the first electric level through the fourth thin film transistor; the nth level scanning signal is at the second electric level, the second thin film transistor and the third thin film transistor are turned off; the enable signal is at the second electric level, the fifth thin film transistor and the sixth thin film transistor are turned off; during the second period of time: the (n−1)th level scanning signal is at the second electric level, the fourth thin film transistor turned off; the nth level scanning signal is at the first electric level, the second thin film transistor and the third thin film transistor are turned on, the data signal is written by the first terminal of the first thin-film transistor through the third thin film transistor; the enable signal is at the second electric level, the fifth thin-film transistor and the sixth thin- film transistor are turned off; during the third period of time: the (n−1)th level scanning signal is at the second electric level, the fourth thin film transistor turned off; the nth level scanning signal is at the second electric level, the second thin film transistor and the third thin film transistor are turned off, the enable signal is at a first electric level, the fifth thin film transistor and the sixth thin film transistor are turned on to drive the OLED to emit light, wherein the nth level scanning signal is delayed by T/M relative to the (n−1)th level scanning signal, wherein M is a positive integer and T is a period of the scanning signal.

2. The OLED driving circuit according to claim 1, wherein the gate of the first thin film transistor is loaded with a compensating leakage current, the compensating leakage current is configured to compensate for an existence of leakage current due to the second thin film transistor and the fourth thin film transistor during the third period of time and leading to the decreasing of the electric potential of the gate of the first thin film transistor.

3. The OLED driving circuit according to claim 1, wherein all of the first thin film transistor, the second thin film transistor, the third thin film transistor, the fourth thin film transistor, the fifth thin film transistor, and the sixth The thin film transistor are PTFT, the first electric level is a low electric level, and the second electric level is a high electric level.

4. The OLED driving circuit according to claim 1, wherein all of the first thin film transistor, the second thin film transistor, the third thin film transistor, the fourth thin film transistor, the fifth thin film transistor, and the sixth The thin film transistor are NTFT, the first electric level is a high electric level, and the second electric level is a low electric level.

5. An OLED display panel, the OLED display panel comprising an OLED driving circuit, the OLED driving circuit is for generating a driving current to drive the OLED, wherein the OLED driving circuit comprising a switch thin film transistor, a driver thin film transistor, a storage capacitor, and a compensation circuit, each of the switch thin film transistor and the driver thin film transistor comprising a gate, a first terminal and a second terminal, a first terminal of the switch thin film transistor receives data signal, a gate of the switch thin film transistor receives the nth level scanning signal, a the second terminal of the switch thin film transistor is electrically connected to a first terminal of the driver thin film transistor, a gate of the driver thin film transistor is electrically connected to a voltage source through the storage capacitor, and a second terminal of the driver thin film transistor is electrically connected to the positive electrode of the OLED through partial of the elements in the compensation circuit, the negative electrode of the OLED is loaded low electrical level, the compensation circuit is configured to compensate for a change of the driving current flowing through the OLED caused by the drift of the threshold voltage of the driver thin film transistor; wherein the first terminal is a source and the second terminal is a drain or the first terminal is a drain and the second terminal is a source, wherein the driver thin film transistor is referred to as a first thin film transistor, the switch thin film transistor is referred to as a third thin film transistor, the compensation circuit comprising a second thin film transistor, a fourth thin film transistor, a fifth thin film transistor, and a sixth thin film transistor, the second thin film transistor, the fourth thin film transistor, the fifth thin film transistor, and the sixth thin film transistor all comprising a gate, a first terminal, and a second terminal, respectively, a gate of the sixth thin film transistor receives the enable signal, a first terminal of the sixth thin film transistor is loaded with the second electrical level, a second terminal of the sixth thin film transistor is electrically connected to the a terminal of the third thin film transistor, a second terminal of the third thin film transistor receives the data signal, and a gate of the third thin film transistor receives the nth level scanning signal, a first terminal of the first thin film transistor is electrically connected to the second terminal of the sixth thin film transistor, a second terminal of the first thin film transistor is electrically connected to a first terminal of the second thin film transistor, a gate of the first thin film transistor is connected to the first terminal of the sixth thin film transistor through the storage capacitor, a second terminal of the second thin film transistor is electrically connected to the gate of the first thin film transistor, and a gate of the second thin film transistor receives the nth level scanning signal, a gate of the fourth thin film transistor receives the (n−1)th level scanning signal, a first terminal of the fourth thin film transistor is electrically connected to the gate of the first thin film transistor, a second terminal of the fourth thin film transistor is loaded with a first electric level, a first terminal of the fifth thin film transistor is electrically connected to the second terminal of the first thin film transistor, a second terminal of the fifth thin film transistor is electrically connected to the positive electrode of the OLED, a gate of the thin film transistor receives the enable signal, and the negative electrode of the OLED is loaded with a low electric level, wherein, the first terminal is a source and the second terminal is a drain, or the first terminal is a drain and the second terminal is a source; during the first period of time: the (n−1)th level scanning signal is at the first electric level, the fourth thin film transistor turned on, the gate of the first thin film transistor is reset to the first electric level through the fourth thin film transistor; the nth level scanning signal is at the second electric level, the second thin film transistor and the third thin film transistor are turned off; the enable signal is at the second electric level, the fifth thin film transistor and the sixth thin film transistor are turned off; during the second period of time: the (n−1)th level scanning signal is at the second electric level, the fourth thin film transistor turned off; the nth level scanning signal is at the first electric level, the second thin film transistor and the third thin film transistor are turned on, the data signal is written by the first terminal of the first thin-film transistor through the third thin film transistor; the enable signal is at the second electric level, the fifth thin-film transistor and the sixth thin-film transistor are turned off; during the third period of time: the (n−1)th level scanning signal is at the second electric level, the fourth thin film transistor turned off; the nth level scanning signal is at the second electric level, the second thin film transistor and the third thin film transistor are turned off, the enable signal is at a first electric level, the fifth thin film transistor and the sixth thin film transistor are turned on to drive the OLED to emit light, wherein the nth level scanning signal is delayed by T/M relative to the (n−1)th level scanning signal, wherein M is a positive integer and T is a period of the scanning signal.

6. The OLED display panel according to claim 5, wherein the gate of the first thin film transistor is loaded with a compensating leakage current, the compensating leakage current is configured to compensate for an existence of leakage current due to the second thin film transistor and the fourth thin film transistor during the third period of time and leading to the decreasing of the electric potential of the gate of the first thin film transistor.

7. The OLED display panel according to claim 5, wherein all of the first thin film transistor, the second thin film transistor, the third thin film transistor, the fourth thin film transistor, the fifth thin film transistor, and the sixth The thin film transistor are PTFT, the first electric level is a low electric level, and the second electric level is a high electric level.

8. The OLED display panel according to claim 5, wherein all of the first thin film transistor, the second thin film transistor, the third thin film transistor, the fourth thin film transistor, the fifth thin film transistor, and the sixth The thin film transistor are NTFT, the first electric level is a high electric level, and the second electric level is a low electric level.

* * * * *